US010345070B1

(12) United States Patent
Lepka

(10) Patent No.: US 10,345,070 B1
(45) Date of Patent: Jul. 9, 2019

(54) SOUND SUPPRESSION DEVICE FOR A FIREARM

(71) Applicant: Armor Specialties LLC, Halifax, PA (US)

(72) Inventor: Lee R. Lepka, Halifax, PA (US)

(73) Assignee: Armor Specialties LLC, Halifax, PA (US)

( * ) Notice: Subject to any disclaimer, the term of this patent is extended or adjusted under 35 U.S.C. 154(b) by 0 days.

(21) Appl. No.: 15/888,186

(22) Filed: Feb. 5, 2018

Related U.S. Application Data

(60) Provisional application No. 62/456,780, filed on Feb. 9, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36
USPC ..... 89/14.05, 14.2, 14.3, 14.4, 14.5, 14.6
See application file for complete search history.

(56) References Cited

U.S. PATENT DOCUMENTS 6,308,609 B1 * 10/2001 Davies ..... F41A 21/30 181/223
7,789,008 B2 * 9/2010 Petersen ..... F41A 21/30 89/14.4
7,832,323 B1 * 11/2010 Davies ..... F41A 21/30 89/14.4
7,856,914 B2 * 12/2010 Shults ..... F41A 21/30 181/223
8,096,222 B2 * 1/2012 Silvers ..... F41A 21/34 181/223
8,162,100 B2 4/2012 Shults et al.
8,453,789 B1 * 6/2013 Honigmann ..... F41A 21/30 181/223
8,459,405 B1 * 6/2013 Dueck ..... F41A 21/30 181/223
8,459,406 B1 * 6/2013 Dueck ..... F41A 21/30 181/223
8,505,680 B2 * 8/2013 Dueck ..... F41A 21/325 181/223
8,567,556 B2 * 10/2013 Dueck ..... F41A 21/30 181/223
8,584,794 B2 * 11/2013 Dueck ..... F41A 21/30 181/223
8,844,422 B1 * 9/2014 Klett ..... F41A 21/30 89/14.2
8,875,612 B1 * 11/2014 Klett ..... F41A 21/30 89/14.4
8,881,862 B1 * 11/2014 Messer, Jr. ..... F41A 21/30 181/223

(Continued)

*Primary Examiner* — Jonathan C Weber
(74) *Attorney, Agent, or Firm* — Hooker & Habib, P.C.

(57) ABSTRACT

A sound suppression device for a firearm includes an inner core and an outer tube surrounding the inner core. The inner core defines a central chamber extending the length of the inner core and has axially spaced baffles that define expansion chambers in fluid communication with the central chamber that enable hot gases generated by the firearm to expand and cool. A cover disposed between the outer tube and the inner core closes the expansion chambers and separates the expansion chambers from the outer tube.

13 Claims, 5 Drawing Sheets

(56) References Cited

U.S. PATENT DOCUMENTS

| | | | | |
|---|---|---|---|---|
| 8,973,481 | B2 * | 3/2015 | Dueck | F41A 21/325 181/223 |
| 9,115,950 | B2 | 8/2015 | Bethlenfalvy | |
| 9,194,640 | B2 * | 11/2015 | Wirth | F41A 21/30 |
| 9,410,761 | B2 | 8/2016 | Morris et al. | |
| 9,482,483 | B2 * | 11/2016 | Whelan | F41A 21/30 |
| 9,482,484 | B2 | 11/2016 | Barney | |
| 2011/0186377 | A1 | 8/2011 | Kline et al. | |
| 2013/0168181 | A1 * | 7/2013 | Wirth | F41A 21/30 181/223 |
| 2013/0180150 | A1 * | 7/2013 | Dueck | F41A 21/325 42/90 |
| 2013/0180796 | A1 * | 7/2013 | Dueck | F41A 21/30 181/223 |
| 2013/0180797 | A1 * | 7/2013 | Dueck | F41A 21/30 181/223 |
| 2014/0157640 | A1 * | 6/2014 | Whelan | F41C 23/16 42/75.02 |
| 2014/0231168 | A1 * | 8/2014 | Dueck | F41A 21/325 181/223 |
| 2015/0001002 | A1 * | 1/2015 | Wirth | F41A 21/30 181/223 |

* cited by examiner

SOUND SUPPRESSION DEVICE FOR A FIREARM

RELATED APPLICATION

This application claims the benefit of U.S. Provisional Patent Application No. 62/456,780 titled "Sound Suppression Device for a Firearm" filed Feb. 9, 2017, which priority provisional patent application is incorporated by reference as if fully set forth herein.

FIELD OF THE DISCLOSURE

This disclosure relates to sound suppression devices for firearms that suppress noise and sparks generated by firing the firearm.

BACKGROUND OF THE DISCLOSURE

Sound suppression devices for firearms (also known as sound suppressors or silencers) typically include an inner core extending along a longitudinal axis, an outer tube that surrounds the inner core, and mounting structure that mounts the inner core to the muzzle end of the firearm with the longitudinal axis of the inner core coaxial with the firing axis of the firearm.

The inner core typically includes a number of longitudinally spaced baffles that define a series of expansion chambers disposed between adjacent pairs of baffles. A projectile discharged from the firearm is received into a central chamber defined by the inner core extending along the longitudinal axis to the discharge end of the inner core. The central chamber is in fluid communication with the expansion chambers. The expansion chambers enable discharge gases produced by firing the firearm to expand and cool, thereby suppressing noise and sparks. The outer tube contains the discharge gases and sparks within the expansion chambers.

Particulates carried by the discharge gases build up on baffle surfaces and on the interior surfaces of the outer tube. Over time, the hot discharge gases can also cause markings, such as serial numbers, on the outer tube to degrade and become unreadable or obliterated.

Thus there is a need for a firearm sound suppression that better resists degradation of markings on the outer tube of the sound suppressor.

SUMMARY OF THE DISCLOSURE

Disclosed is a sound suppression device for a firearm that better resists degradation of markings on the outer tube of the sound suppressor.

A sound suppression device in accordance with the disclosure includes an inner core extending along a longitudinal axis, the inner core including a number of longitudinally spaced baffles defining a series of expansion chambers between adjacent pairs of the baffles, an outer tube surrounding the inner core, and a cover disposed between the inner member and the outer core closing the expansion chambers. The cover protects the outer tube from the hot gases and sparks generated by the firing.

In an embodiment of the sound suppression device, the inner member includes a pair of longitudinal beams disposed on opposite sides of the central chamber. The cover includes a pair of cover members received in pockets defined by recessed surfaces formed on the beams.

In yet another embodiment of the sound suppression device, the cover is formed as a tubular member that slides over the baffles.

The cover of the disclosed sound suppression device has a number of advantages. The cover protects the outer tube from hot gases and sparks and thereby resists degrading the markings on the outer tube. The cover is easily removable from the inner core for cleaning or replacement.

Other objects and features of the disclosure will become apparent as the description proceeds, especially when taken in conjunction with the accompanying drawing sheets illustrating one or more illustrative embodiments.

DETAILED DESCRIPTION

FIGS. 1-9 illustrate a first embodiment sound suppression device or sound suppressor 10 in accordance with this disclosure.

Figure 1:
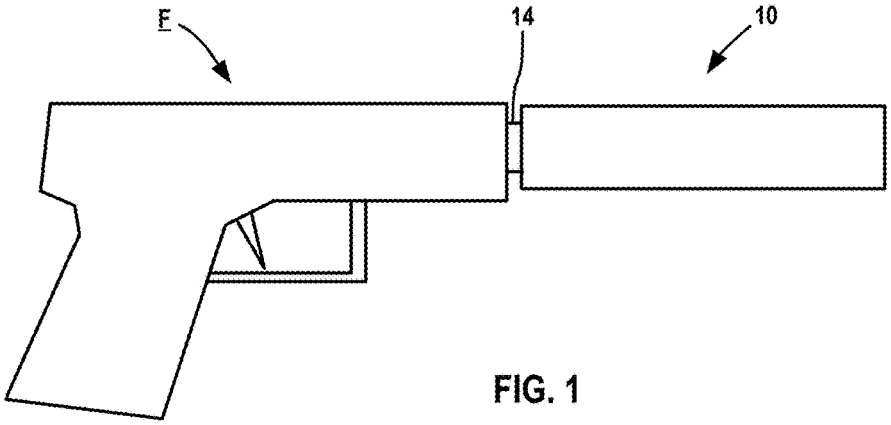
FIG. 1 is a front schematic view of a first embodiment sound suppression device attached to a firearm by a muzzle mount.

FIG. 1 illustrates a conventional firearm F having the sound suppression device 10 attached to the muzzle end of the firearm by a muzzle attachment device 14. A projectile fired from the firearm passes through the sound suppression device, the sound suppression device acting to suppress noise, muzzle flash, and sparks generated by the firing.

Figure 2:
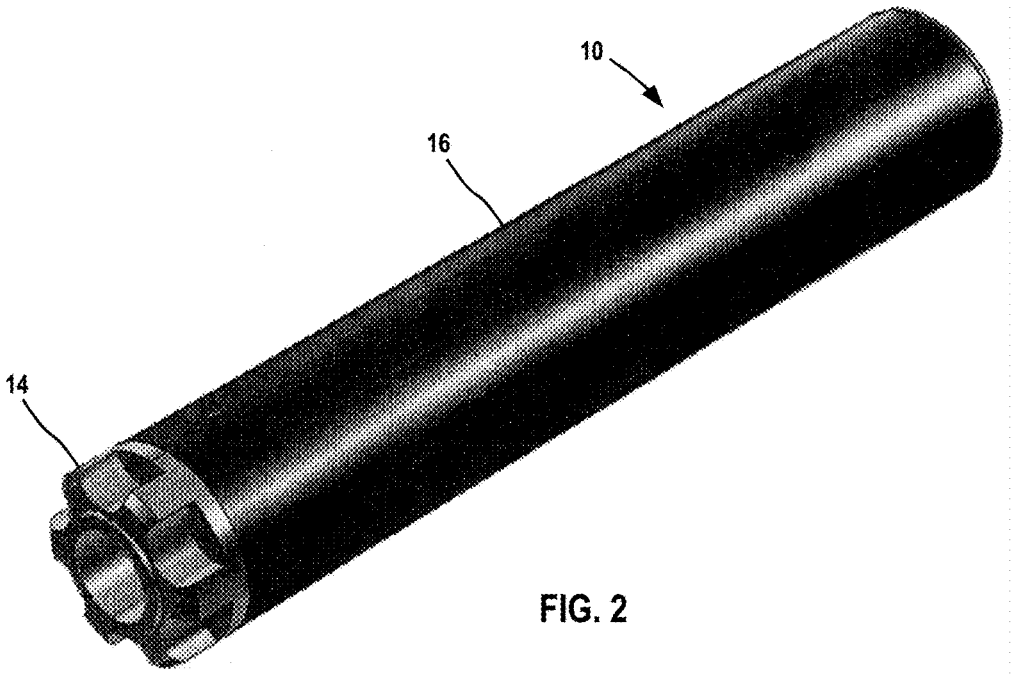
FIG. 2 is a perspective view of the sound suppression device shown in FIG. 1 with a muzzle mount attached.
Figure 3:
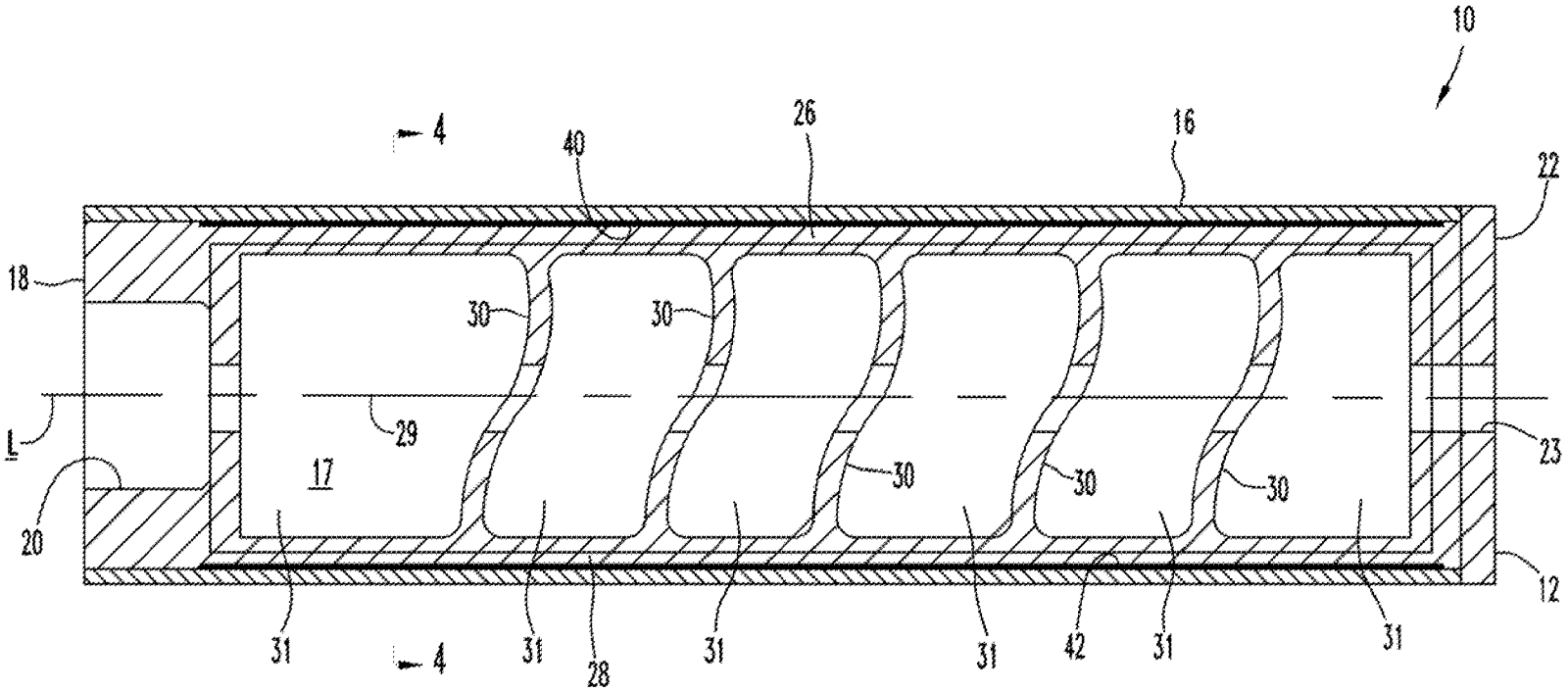
FIG. 3 is a vertical longitudinal sectional view of the sound suppression device shown in FIG. 1.

FIG. 2 illustrates the muzzle attachment device 14 attached to the sound suppression device 10 but not attached to the firearm. Different muzzle attachment devices are known for attaching a sound suppression device to a muzzle end of a firearm and conventional muzzle attachment devices can be adapted for use with the disclosed sound suppression device.

FIGS. 3-9 illustrate the sound suppression device or sound suppressor 10 and its components. The sound suppressor 10 includes a monolithic (one-piece) inner core 12 that receives a projectile fired from the firearm F, a conventional outer tube 16 that closely surrounds the inner core 12, and a cover 17 disposed between the inner core 12 and the outer tube 16.

The illustrated outer tube 16 has an inner circular-cylinder wall and includes markings (not shown) such as serial number and manufacturer's information.

The inner core 12 includes a first end wall 18 having a through bore 20 disposed on an attachment or intake end of the inner core and an opposite end wall 22 disposed on a muzzle or discharge end of the inner core having a through bore 23. The end walls 18, 22 are each formed as a circular thick-walled cylinder. The bore 20 enables the projectile fired from the firearm F to enter the sound suppressor 10. The bore 23 enables the projectile to exit the sound suppressor. The bore 20 is threaded for removable attachment of the muzzle attachment device 14.

The inner core 12 extends along a longitudinal central axis L from the intake end to the discharge end of the sound suppressor 10. A thin, radially enlarged rim or flange 24 is disposed on the discharge end of the inner core 12. The flange 24 has an outer diameter equal to the outside diameter of the outer tube 16 and resists axial movement of the outer tube 16 towards the muzzle end of the inner core.

Additional axial through-holes extending through the end wall 22 can be provided to enable the escape of gases from inside the sound suppressor after firing.

The inner core 12 includes a member that in cooperation with the wall bores 20, 23 defines a central channel extending the full length of the inner core for projectile travel along the axis L. In the illustrated embodiment the member is formed as a pair of longitudinal beams 26, 28 that extend along the longitudinal axis from the first end wall 18 to the second end wall 22. The beams 26, 28 are disposed along and cooperate with the through-bores 20, 23 to define a central channel 29 extending the full length of the inner core 12. The beams are spaced 180 degrees apart from each other along the channel and include like circular-arc shaped outer surfaces 29 that have a radius of curvature that enables the outer beam surfaces 29 to closely conform with the facing inner cylinder wall of the outer tube 16.

A number of baffles 30 are held between the beams and are spaced apart from one another along the longitudinal axis of the inner core 12. In this construction the front and end walls 18, 22 also function as baffles. The baffles define and are located on axially opposite sides of expansion chambers 31 surrounding the central channel 29 and in fluid communication with the central channel 29. The expansion chambers 31 are spaced axially along the central channel 29 and extend radially outwardly away from the central channel 29.

Each baffle 30 has a circular-arc shaped outer surface that is covered by the cover 17 as will be described below. Otherwise the baffle construction is conventional and so will not be described in further detail.

Each beam 26, 28 and the walls 18, 22 have formed on them cooperating recessed surfaces 32. 34 bounded by respective radially-extending walls 36, 38 that are concentric with the longitudinal axis L of the inner core 12. The surfaces 32, 34 have a radius of curvature about the longitudinal axis that is reduced from the outer radius of the beam by the radial height of the walls 36, 38.

The cover 17 in the illustrated embodiment is formed as a pair of cover plates 40, 42. The recessed surfaces 32, 34 define cooperating "pockets" that closely receive and hold the pair of stainless steel cover plates 40, 42. The radial walls 36, 38 cooperate to resist axial displacement of the cover plates along the longitudinal axis of the inner core 12 when the cover plates are in the pockets. The cover plates are removably received within the pockets for ease of cleaning the sound suppressor 10 and for cover plate replacement when necessary.

The cover plates 40, 42 are sized to be closely received between the circumferentially adjacent pairs of walls 36, 38 and overlay the recessed surfaces 32, 34 when received in the pockets. The cover plates 40, 42 have a circular arc cross section having a thickness substantially equal to the height of the walls 36, 38. The inner radius of curvature of each cover plate 40, 42 is about equal to the radius of curvature of the recessed surfaces 32, 34. The outer radius of curvature of each cover plate 40, 42 is about equal to the outermost radius of curvature of the outermost cylindrical surfaces of the walls 18, 22. The walls 36, 38 are shaped to closely face and conform with the adjacent outer perimeter sides of the cover plates.

The cover plates 40, 42 each extend along the longitudinal axis of the inner core 12 and closely fit over the baffles 30 and end walls 18, 22. The cover plates 40, 42 close the expansion chambers 31 and separate the expansion chambers from the outer tube 16.

The cover plates 40, 42 and the beams 26, 28 cooperate to define a baffle tube 44 closed by the end walls 20, 22 extending from the wall 18 of the inner cover to closely adjacent the rim 24 that is closely received within the outer tube 16.

When the sound suppressor 10 is attached to the firearm F for use, the outer tube 16 is essentially sandwiched between the muzzle end of the firearm and the enlarged rim 24. The cover plates 42, 44 close the expansion chambers 31 and are radially closely spaced from the inner wall of the outer tube 16.

When a projectile is fired through the sound suppressor 10, the projectile enters the sound suppressor 10 through the front end bore 20, moves through the central channel 29, and exits the sound suppressor through the muzzle end bore 23. Hot gases generated by the firing radially expand and cool in the expansion chambers 31. The gases can escape the sound suppressor through the opening(s) in the second end wall 20.

The cover plates 40, 42 cooperate with the beams 26, 28 to protect the outer tube 16 from the hot gases and sparks generated by the firing. The gases expanding in the expansion chambers 31 urge the cover plates 40, 42 radially away from the longitudinal axis of the inner core. The outer tube 16 resists radial displacement of the cover plates 40, 42 away from the inner core 12 that would otherwise be sufficient for the covers to clear the radial walls 36, 38. The radial walls 36, 38 and the flange 24 resist axial displacement of the cover plates 40, 42 along the inner core 12 during firing. Gases therefore expand within the expansion chambers 31 without directly engaging or impinging against the outer tube 16.

The tube 44 cooperates with the end walls 20, 22 in resisting contact of particulates and gases directly against the inside of the outer tube 16 and thereby resisting degradation of markings on the outer tube.

The recessed surfaces 32, 34 of the illustrated embodiment have a 0.875 inch radius of curvature. The radial walls 36. 38 extend radially 0.027 inches (27 mils, wherein 1 mil equal to one-thousandth of an inch) from the recessed surfaces. The thickness of the cover plates 40, 42 is 25 mils. However, steel tubing having a 25 mil wall thickness and 0.875 inch inner diameter was not found to be commercially available.

A process for manufacturing the illustrated cover plates 40, from seamless stainless steel tubing having a 49 mil wall thickness and 1 inch inner diameter is described next and can be adapted for other tube sizes and/or cover geometries.

Turn down on a lathe a 6 inch long piece of the tubing to the desired 25 mil wall thickness, leaving one inch of full size tubing on each end of the turned-down portion for the next operation. Remove from the lathe and place a holder in each end of the tube. Place the assembly in the CNC $4^{th}$ axis rotary table. With the appropriate cutting program loaded, start the CNC to cut out the shape of the cover. Remove and de-burr as necessary. As stainless steel, in tubing, is under tension, it is necessary to reshape the covers once the shape has been cut out.

The process may vary as needed for different cover thicknesses, sizes, shapes, or materials.

It is not required that in embodiments of the disclosed sound suppression device having multiple cover plates, that the cover plates necessarily must be identical or nearly-identical in shape with one another.

The sound suppression device 10 includes a pair of cover plates 40, 42 that span between the pairs of beams 26, 28. Other embodiments of the disclosed sound suppressor may include a single-piece baffle cover formed as a one-piece tube.

Figure 4:
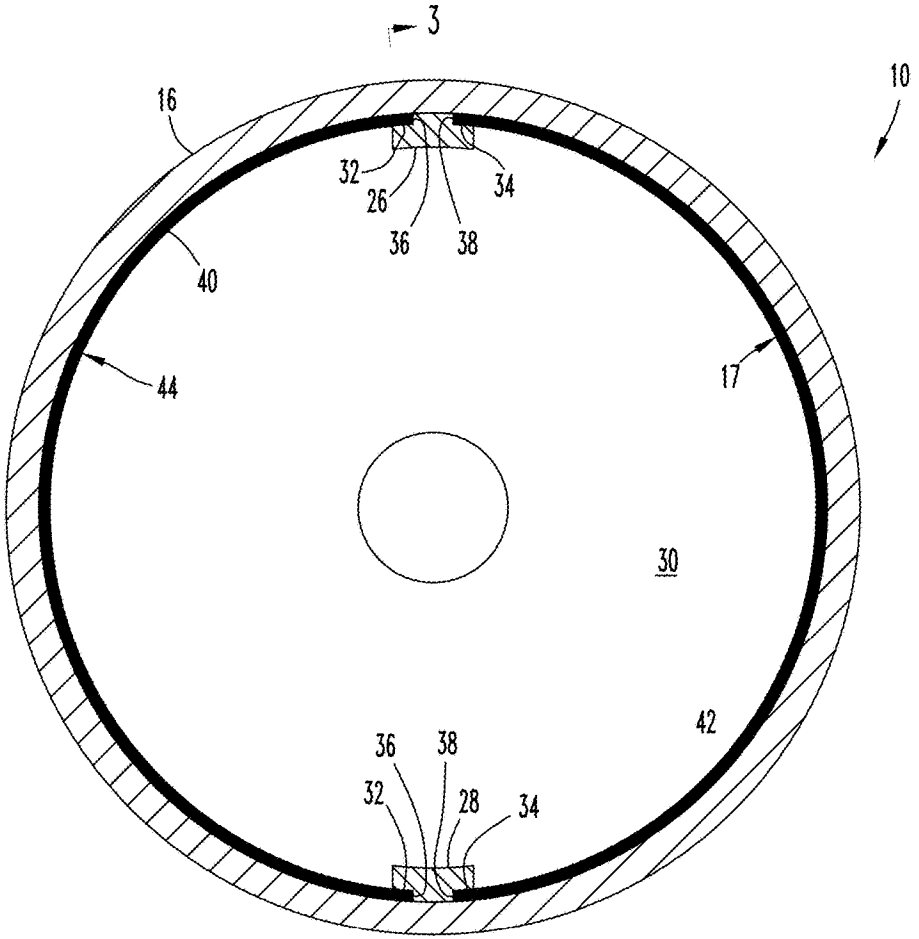
FIG. 4 is a vertical cross-section view of the sound suppression device taken along lines 4-4 of FIG. 3.
Figure 5:
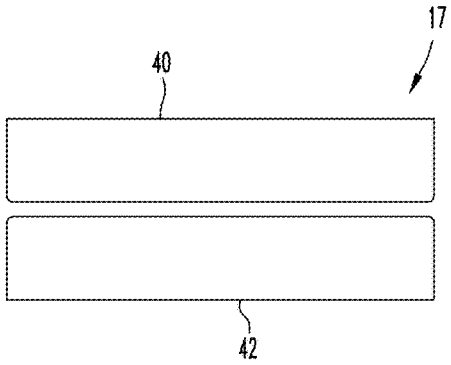
FIG. 5 is a front longitudinal view of the two cover plates of the sound suppression device shown in FIG. 1.
Figure 6:
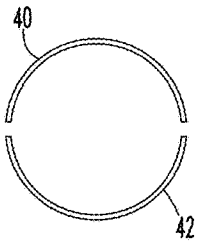
FIG. 6 is an end view of the two cover plates shown in FIG. 5.
Figure 7:
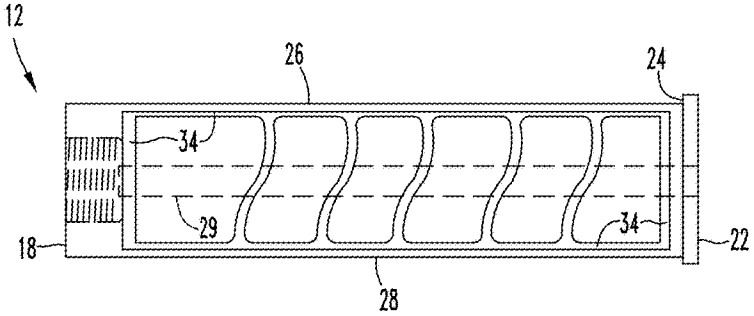
FIG. 7 is a top view of the inner core of the sound suppression device shown in FIG. 1.
Figure 8:
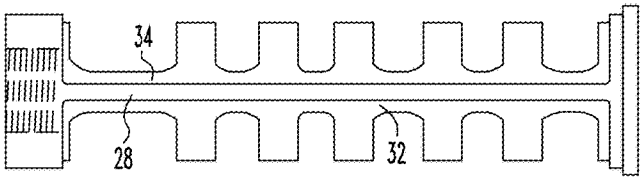
FIG. 8 is a front view of the inner core shown in FIG. 7.
Figure 9:
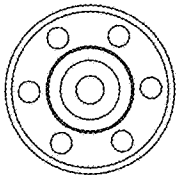
FIG. 9 is an end view of the inner core shown in FIG. 8.
Figure 10:
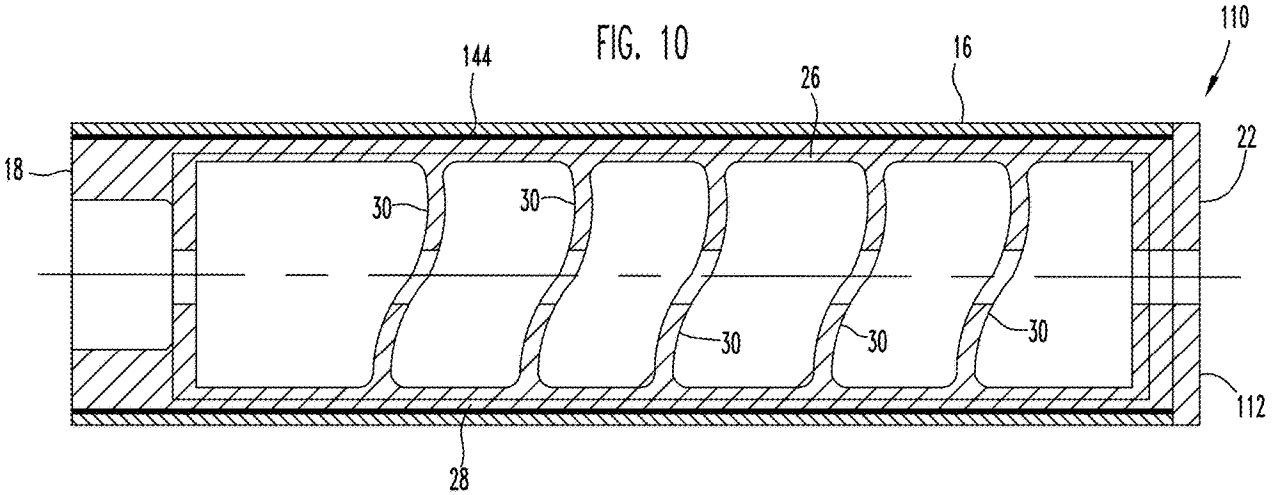
FIG. 10 is a vertical longitudinal sectional view similar to FIG. 3 but of a second embodiment sound suppression device.
Figure 12:
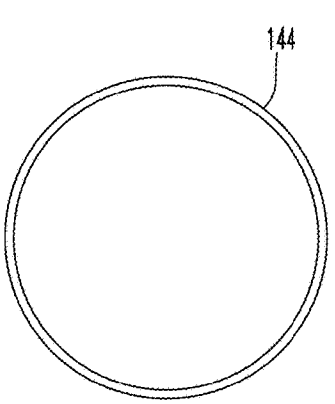
FIG. 12 is an end of the baffle cover shown in FIG. 11.
Figure 11:
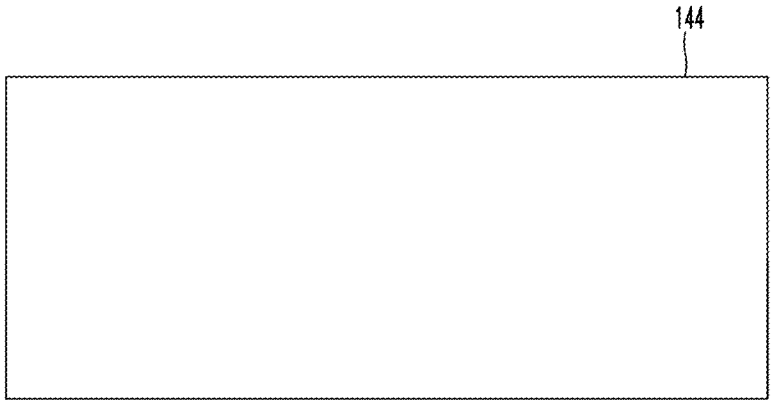
FIG. 11 is a front view of the one-piece baffle cover of the sound suppression device shown in FIG. 10.

FIG. 10 is a view of a second embodiment sound suppression device 110 that is similar to FIG. 4 of the sound suppression device 10. The sound suppression device 110 is otherwise substantially similar to the sound suppression device 10 but the cover 17 is formed as a one-piece baffle tube 144 that closes the expansion chambers 31 (see FIGS. 11 and 12), and the inner core 112 is modified from the inner core 12 to be received within the baffle tube 144. The inner cylindrical wall of the cover tube 144 closely surrounds the diametrically outer surfaces of the front and back walls 18, 22, the beams 26, 28 and the baffles 30 of the inner core 112. The outer cylindrical wall of the cover tube 144 is sized to be closely received within the outer tube 16.

Yet other embodiments of the disclosed sound suppression device may include three or more cover plates that cooperate to close the expansion chambers. Other firearm sound suppressor inner core designs are also known and the number of covers can be readily adapted to best conform to the geometry of alternative inner core designs.

In possible embodiments, recessed surfaces can be formed on the baffles or inner core walls instead of or in addition to the recessed surfaces on the beams to receive and support covers. A cover can span more than one expansion chamber. Baffles spanned by a cover can be formed without recessed surfaces and sized to closely fit beneath the overlaying cover.

In possible embodiments of the disclosed sound suppression device, the cover or cover plates may form an expansion chamber cover that is rectangular in cross section or some other cross section shape as necessary to closely conform with the inside of the outer tube. For example, Schults et al. U.S. Pat. No. 8,162,100 incorporated by reference herein discloses a sound suppression device having an outer tube with generally planar, and not curved, inner surfaces. The inner core can be supplied with a cover or cover plates that closely conform to the planar inner surfaces of the outer tube. Bethlenfalvy U.S. Pat. No. 9,115,950 incorporated by reference herein discloses a sound suppression device having an inner core and outer tube in which the inner core includes an elongate tube that extends between radially enlarged end walls. The tube receives the projectile and through openings are formed in the tube spaced along the length of the tube. A cover formed as a circular tube can extend the length of the tube and have an inner wall spaced away from the tube. The inner core and cover is received within the outer tube.

Other sound suppression devices for firearms that could be modified to include an inner core cover or cover plates as disclosed herein include, but are not limited to, those disclosed in Morris et al. U.S. Pat. No. 9,410,761, Barney U.S. Pat. No. 9,482,484, and Kline et al. US Patent Application Publication 2011/0186377, each of which are incorporated by reference as if fully set forth herein.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, operating ranges (temperature, volume, displacement, stroke length, concentration, and the like), or environment of use.

What is claimed is:

1. A sound suppression device for a firearm comprising:

an inner core, an outer tube comprising an inner wall that closely surrounds the inner core, and a cover being disposed between the inner core and the outer tube, the cover comprising a plurality of cover plates;

the inner core extending along a longitudinal axis between opposite intake and discharge ends defining a length of the inner core, the inner core defining a central chamber extending along the axis the length of the inner core, the inner core comprising a plurality of baffles disposed along the longitudinal axis, the baffles axially spaced apart from one another with adjacent pairs of baffles defining respective expansion chambers extending radially outwardly from the longitudinal axis; and the inner core comprising an outer surface that closely conforms with the inner wall of the outer tube and a plurality of radially recessed surfaces bounded by radially-extending walls, the radially recessed surfaces defining pockets of the inner core;

the cover plates being closely received in the pockets of the inner core, the cover plates overlaying the recessed surfaces of the inner core, the cover plates being substantially flush with the outer surface of the inner core so as to be closely spaced from the inner wall of the outer tube, the plurality of cover plates closing the expansion chambers and separating the expansion chambers from the outer tube.

2. The sound suppression device of claim 1 wherein the inner core comprises a wall disposed at a discharge end of the inner core, the central channel extending through the wall, the wall comprising a radially enlarged flange disposed at the discharge end, the flange being disposed to resist axial movement of the outer tube past the flange.

3. The sound suppression device of claim 1 wherein each cover plate of the plurality of cover plates has a circular-arc cross section.

4. The sound suppression device of claim 3 wherein the outer surface of the inner core is a curved surface having a radius of curvature, and each cover plate has an outer radius of curvature substantially equal to the radius of curvature of the outer surface of the inner core.

5. The sound suppression device of claim 1 wherein the inner core comprises a plurality of beams extending longitudinally along the central channel, the plurality of recessed surfaces comprises a pair of recessed surfaces disposed on each beam, and the outer surface of the inner core is at least partially disposed on each of the plurality of beams.

6. The sound suppression device of claim 1 wherein the plurality of beams consists of a first beam and a second beam, the plurality of cover plates comprise a first cover plate and a second cover plate, and each of the first and second cover plates extends from a pocket on the first beam to a pocket on the second beam.

7. The sound suppression device of claim 1 wherein each cover plate of the plurality of cover plates extends over all the baffles.

8. The sound suppression device of claim 1 wherein the outer tube has a circular cross section.

9. The sound suppression device of claim 1 wherein each cover plate of the plurality of cover plates is a stainless steel cover plate.

10. The sound suppression device of claim 1 wherein the inner core is a one-piece member.

11. The sound suppression device of claim 1 wherein the inner core comprises a first wall disposed at the intake end of the inner core, the first wall comprising at least one of the said plurality of radially recessed surfaces.

12. The sound suppression device of claim 11 comprising a second wall disposed at the discharge end of the inner core, the second wall comprising at least one of the said plurality or radially recessed surfaces.

13. The sound suppression device of claim 1 in combination with a firearm, the sound suppression device attached to the firearm, the sound suppression device disposed with respect to the firearm wherein a projective fired from the firearm travels through the central chamber of the sound suppression device.

* * * * *